US006964495B2

(12) United States Patent
Schnaufer et al.

(10) Patent No.: US 6,964,495 B2
(45) Date of Patent: Nov. 15, 2005

(54) PORTABLE REDUCED-EMISSIONS WORK LIGHT

(75) Inventors: David M. Schnaufer, Harrisburg, NC (US); Thomas S. Crates, Clover, SC (US)

(73) Assignee: MacLean Jameson, LLC, Clover, SC (US)

( * ) Notice: Subject to any disclaimer, the term of this patent is extended or adjusted under 35 U.S.C. 154(b) by 0 days.

(21) Appl. No.: 09/862,773

(22) Filed: May 21, 2001

(65) Prior Publication Data

US 2002/0172037 A1 Nov. 21, 2002

(51) Int. Cl.[7] ..... F21V 7/10

(52) U.S. Cl. ..... 362/216; 362/221; 362/310; 362/375; 362/376; 362/399; 362/224

(58) Field of Search ..... 174/36, 35 C, 174/102 R, 102 SP, 107, 108, 113 R; 315/85; 362/216, 217, 224, 221, 226, 260, 307, 310, 362/363, 374, 378, 319, 377, 375, 376, 396, 362/390, 399, 400

(56) References Cited

U.S. PATENT DOCUMENTS 2,233,280 A * 2/1941 Barnes ..... 362/319
4,945,461 A 7/1990 Crates
5,043,530 A * 8/1991 Davies ..... 174/102 R
5,262,592 A * 11/1993 Aldissi ..... 174/36
5,528,477 A * 6/1996 Carmo ..... 362/260
5,564,821 A 10/1996 Hesprich
5,738,438 A 4/1998 Hesprich
5,765,941 A * 6/1998 Vest ..... 313/50
5,860,730 A 1/1999 Hesprich
6,005,191 A * 12/1999 Tzeng et al. ..... 174/102 R
6,169,373 B1 * 1/2001 Riesinger ..... 315/178

OTHER PUBLICATIONS

Pauluhn Light; Bruce Industries Inc.; Published prior to May 21, 2001.

* cited by examiner

*Primary Examiner*—John Anthony Ward
*Assistant Examiner*—Berterand Zeade
(74) *Attorney, Agent, or Firm*—Adams Evans P.A.

(57) ABSTRACT

A reduced emissions work light includes a bulb with an elongated bulb tube. A handle is provided adjacent the bulb, and is adapted for being gripped by a user to manipulate the work light. An emissions containment housing is located within the handle. A ballast is located within the housing, and is operatively connected to the bulb. An emissions filter is located within the housing, and is operatively connected to the ballast. The filter and housing cooperate to reduce emissions generated by the work light.

18 Claims, 17 Drawing Sheets

PORTABLE REDUCED-EMISSIONS WORK LIGHT

TECHNICAL FIELD AND BACKGROUND OF THE INVENTION

This invention relates to a portable, reduced-emissions work light. The invention has particular application for military use in special purpose tents, referred to as modular command post units (MCPU), and other mobile military shelters, such as lightweight maintenance enclosures (LME). The invention meets military requirements for electromagnetic interference (EMI) emissions, and includes shock-absorbing components which protect the light from damage caused by dropping or other sudden impact. The invention is light weight and has a convenient handle at one or both ends. In addition, the invention includes snap-together components which enable quick and convenient assembly and disassembly.

SUMMARY OF THE INVENTION

Therefore, it is an object of the invention to provide a portable, hand-held work light which generates reduced emissions.

It is another object of the invention to provide a work light which is especially applicable for military use, and which meets military specifications for EMI emissions.

It is another object of the invention to provide a work light which does not interfere with the performance of equipment which may be potentially sensitive to low frequency magnetic fields.

It is another object of the invention to provide a work light which is relatively lightweight.

It is another object of the invention to provide a work light which includes snap-together components for ready assembly and disassembly.

It is another object of the invention to provide a work light which enables convenient and safe removal and replacement of a defective or inoperative ballast.

It is another object of the invention to provide a work light which generates a minimum of five-foot candles of light at 30 inches off the ground.

It is another object of the invention to provide a work light which is impact resistant.

It is another object of the invention to provide a mobile shelter, such as a military MCPU and LME, which includes one or more reduced emissions work lights.

It is another object of the invention to provide a mobile shelter which includes an energy efficient lighting system.

These and other objects of the present invention are achieved in the preferred embodiments disclosed below by providing a reduced emissions work light. The work light comprises a bulb including an elongated bulb tube. A handle is provided adjacent the bulb, and is adapted for being gripped by a user to manipulate the work light. An emissions containment housing is located within the handle. A ballast is located within the housing, and is operatively connected to the bulb. An emissions filter is located within the housing, and is operatively connected to the ballast. The filter and housing cooperate to reduce emissions generated by the work light.

According to another preferred embodiment of the invention, a tubular, light-transmitting protective shield surrounds the bulb tube to protect the bulb from damage.

According to yet another preferred embodiment of the invention, a cylindrical shock-absorbing plug is positioned within the protective shield and engages a free end of the bulb tube to further protect the bulb from damage.

According to yet another preferred embodiment of the invention, the plug includes an interior web for being gripped to remove the plug from the protective shield.

According to yet another preferred embodiment of the invention, a shock-absorbing end cap is positioned over an end of the protective shield opposite the handle.

According to yet another preferred embodiment of the invention, a switch opening is formed in the emissions containment housing to accommodate a ballast activation switch in the handle.

According to yet another preferred embodiment of the invention, a removable color filter is positioned over the protective shield to filter light emitted by the bulb.

According to yet another preferred embodiment of the invention, a power supply cord is adapted for being connected to a power source to supply electrical power to the work light.

According to yet another preferred embodiment of the invention, an emissions insulating sheath is provided over the power supply cord to further reduce emissions generated by the work light.

In another embodiment, the invention is a reduced emissions work light including a flourescent bulb with electrode pins, a pin base, and an elongated bulb tube extending outwardly from the pin base. A handle is provided adjacent the bulb, and is adapted for being gripped by a user to manipulate the work light. An emissions containment housing is located within the handle. The housing comprises a hollow cylindrical metal ballast cup. A ballast is located within the cup and is operatively connected to the bulb. A ballast activation switch is accessible through an opening formed in the cup to activate the ballast at the handle. An emissions filter is located within the cup and is operatively connected to the ballast. The filter and housing cooperate to reduce emissions generated by the work light.

According to another preferred embodiment of the invention, the ballast includes electrical wires having respective terminal ends operatively connected to respective pins of the flourescent bulb.

According to yet another preferred embodiment of the invention, a bulb socket is located between the flourescent bulb and the ballast. The bulb socket defines a plurality of longitudinal through-bores receiving respective wire ends of the ballast from a first end thereof and respective electrode pins of the bulb from an opposite second end thereof.

According to yet another preferred embodiment of the invention, the bulb socket includes enlarged conical openings at its first end. The enlarged openings are adapted for receiving respective electrode pins into the longitudinal through-bores.

According to yet another preferred embodiment of the invention, the bulb socket is formed of a molded plastic material.

According to yet another preferred embodiment of the invention, a cylindrical resilient shock is formed around the bulb socket at an open proximal end of the cup.

According to yet another preferred embodiment of the invention, the resilient shock includes an inwardly-tapered guide recess adapted for guiding the pins of the bulb into the through-bores of the bulb socket.

In yet another embodiment, the invention is a reduced emissions work light including a bulb with an elongated bulb tube. A perforated, emissions insulating screen surrounds the bulb tube. A handle is adjacent the bulb, and is adapted for being gripped by a user to manipulate the work light. An emissions containment housing is located within the handle. A ballast is located within the housing, and is operatively connected to the bulb. An emissions filter is located within the housing, and is operatively connected to the ballast. The filter, housing, and screen cooperate to reduce emissions generated by the work light.

According to yet another preferred embodiment of the invention, a light reflector is located adjacent the bulb tube for enhancing illumination of the bulb.

According to yet another preferred embodiment of the invention, an elongated pull strip is releasably attached to the bulb for removing the bulb from the work light for replacement.

In yet another embodiment, the invention is a reduced emissions work light including a bulb with an elongated bulb tube. A perforated, emissions insulating screen surrounds the bulb tube. A light-transmitting protective shield surrounds the bulb tube and screen to protect the bulb from damage. A handle is provided adjacent the protective shield, and is adapted for being gripped by a user to manipulate the work light. An emissions containment housing is located within the handle. A ballast is located within the housing, and is operatively connected to the bulb. An emissions filter is located within the housing, and is operatively connected to the ballast. A power supply cord is adapted for being connected to a power source to supply electrical power to the work light. The power supply cord includes an emissions insulating sheath. The filter, housing, screen, and sheath cooperate to reduce emissions generated by the work light.

In yet another embodiment, the invention is a mobile shelter system erected to create a covered interior. The shelter system includes one or more portable reduced-emissions work lights adapted for illuminating the interior of the shelter system.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
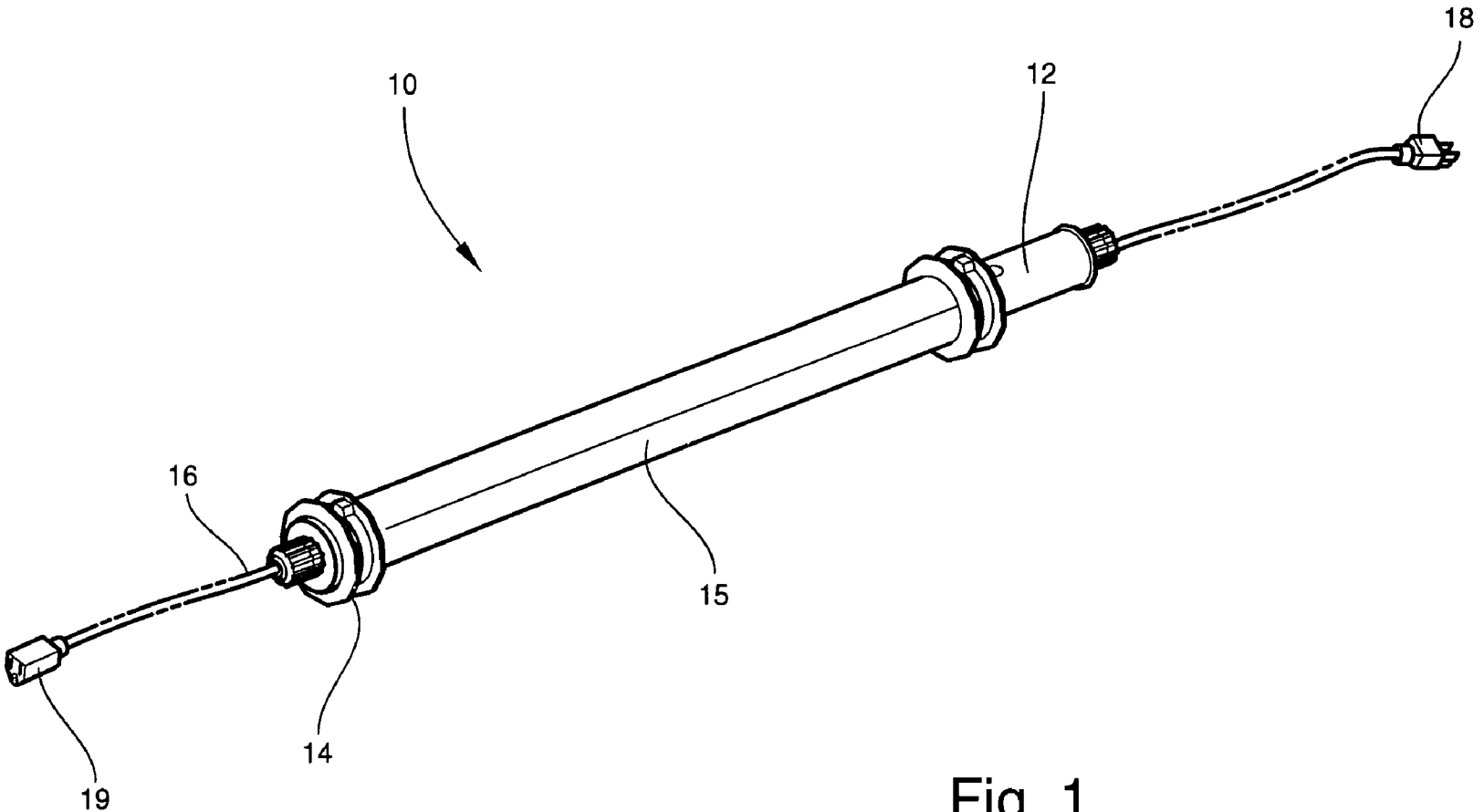
FIG. 1 is a perspective view of a reduced emissions work light according to one preferred embodiment of the invention.
Figure 2:
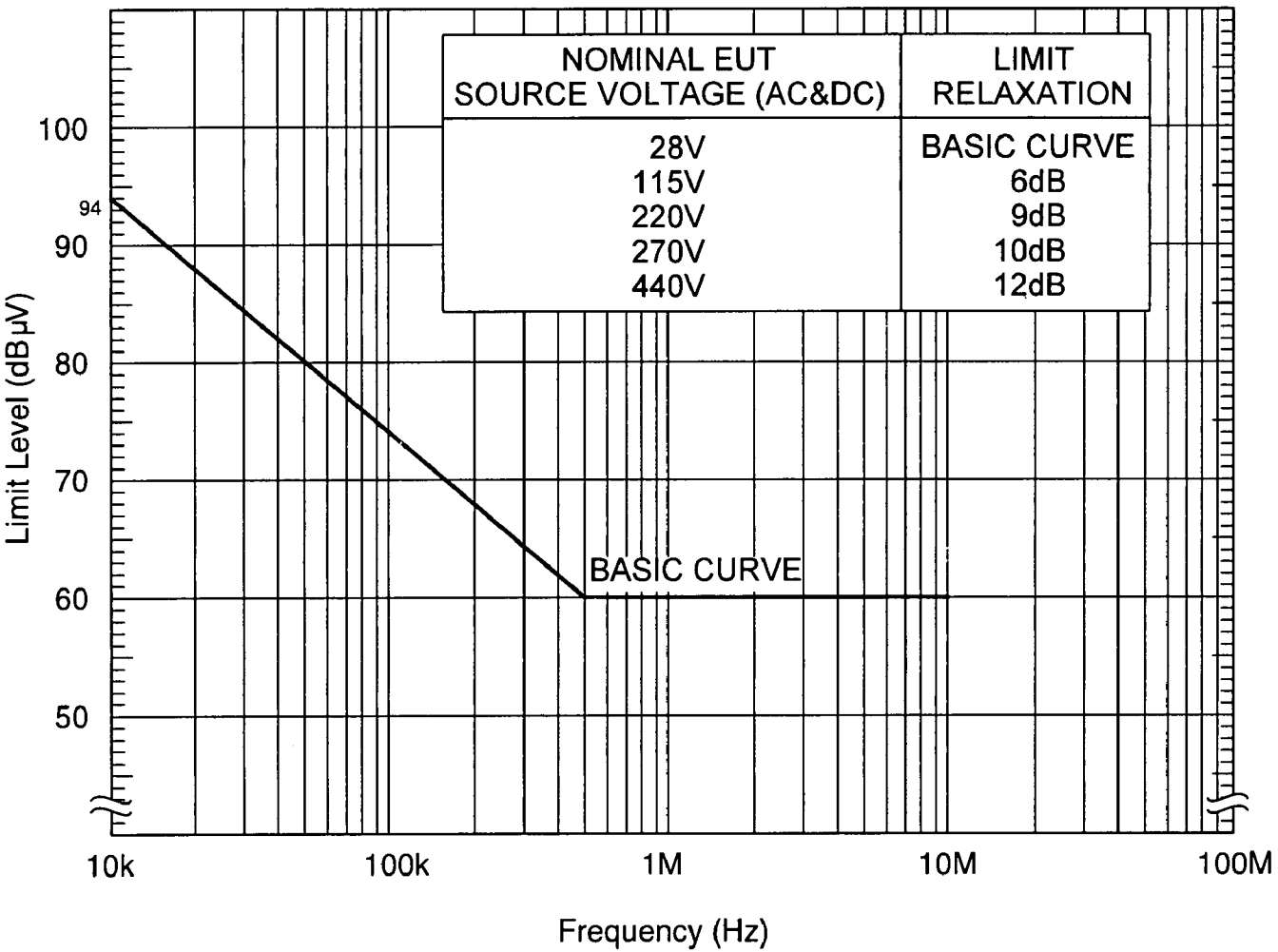
FIG. 2 is a graph illustrating certain military requirements for conducted emissions applicable to the work light.
Figure 3:
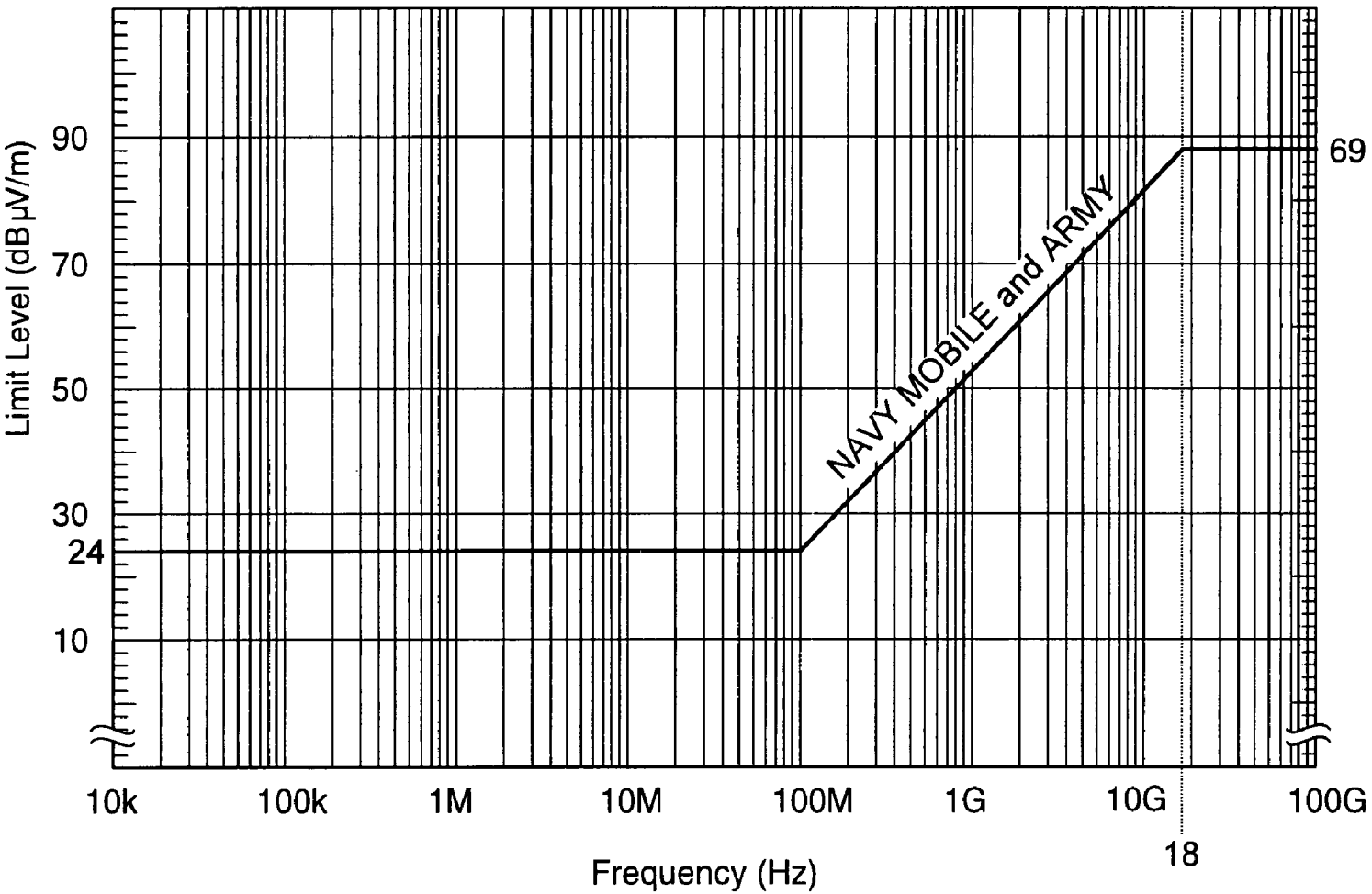
FIG. 3 is a graph illustrating certain military requirements for radiated emissions applicable to the work light.

Referring now specifically to the drawings, a reduced emissions work light according to the present invention is illustrated in FIG. 1 and shown generally at reference numeral 10. The work light 10 has particular application for military use in special purpose tents, referred to as modular command post units (MCPU), and other mobile military shelters, such as lightweight maintenance enclosures (LME). FIGS. 2 and 3 are graphs illustrating military specifications for conducted and radiated emissions, respectively. The present work light 10 meets these specifications. In FIG. 2, the basic curve is adjusted 6 dB at 115V for the present work light 10. The complete text outlining the military requirements for the control of EMI emissions is incorporated herein by reference. See MIL-STD-461D, Jan. 11, 1993, revised Jun. 19, 1997. Preferably, the work light 10 weighs between 3 and 5 pounds, and is manufactured in various lengths ranging from between 30 and 40 inches.

Figure 4:
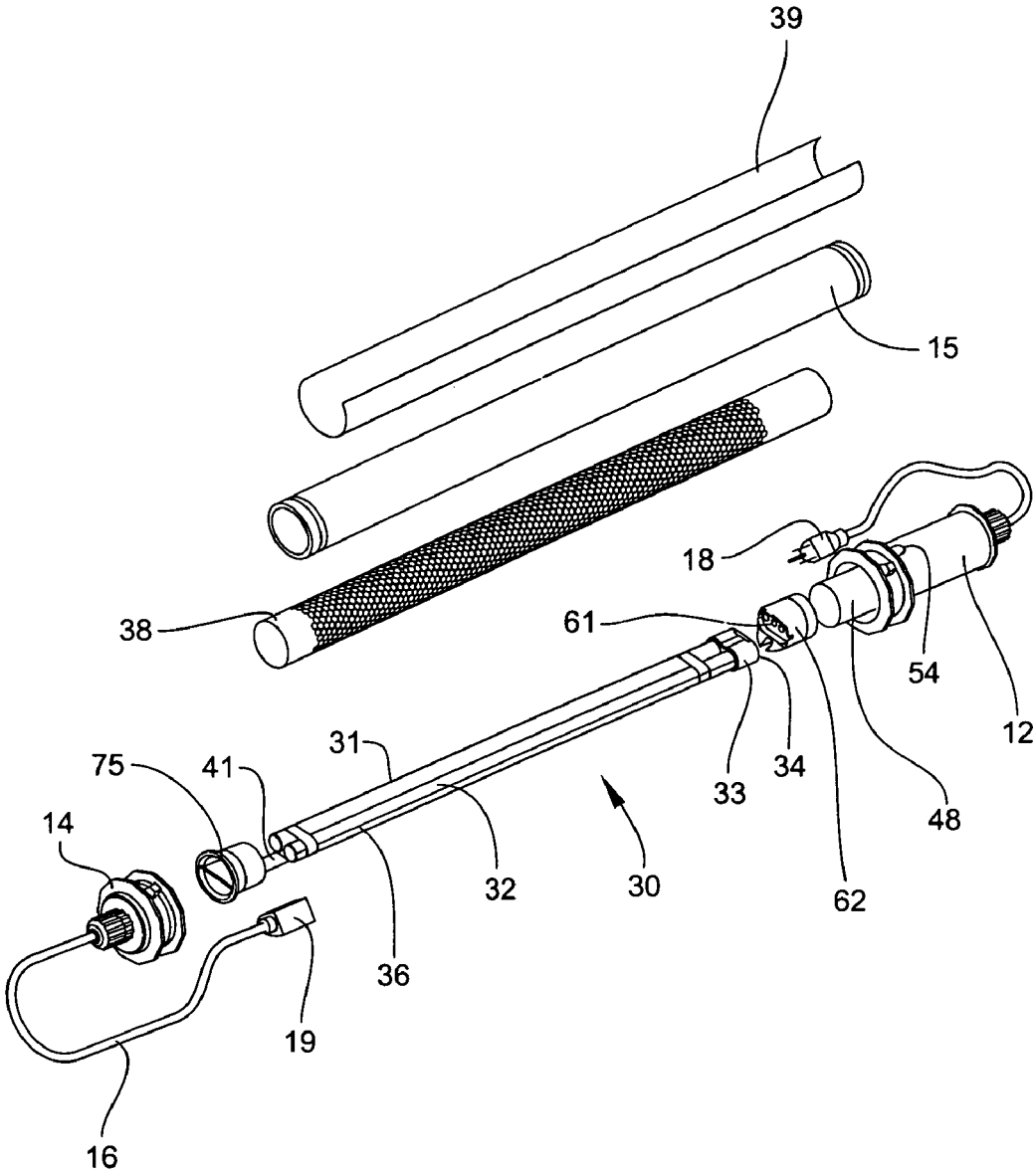
FIG. 4 is a perspective view of the work light with certain interior components pulled apart and certain outer components removed.
Figure 5:
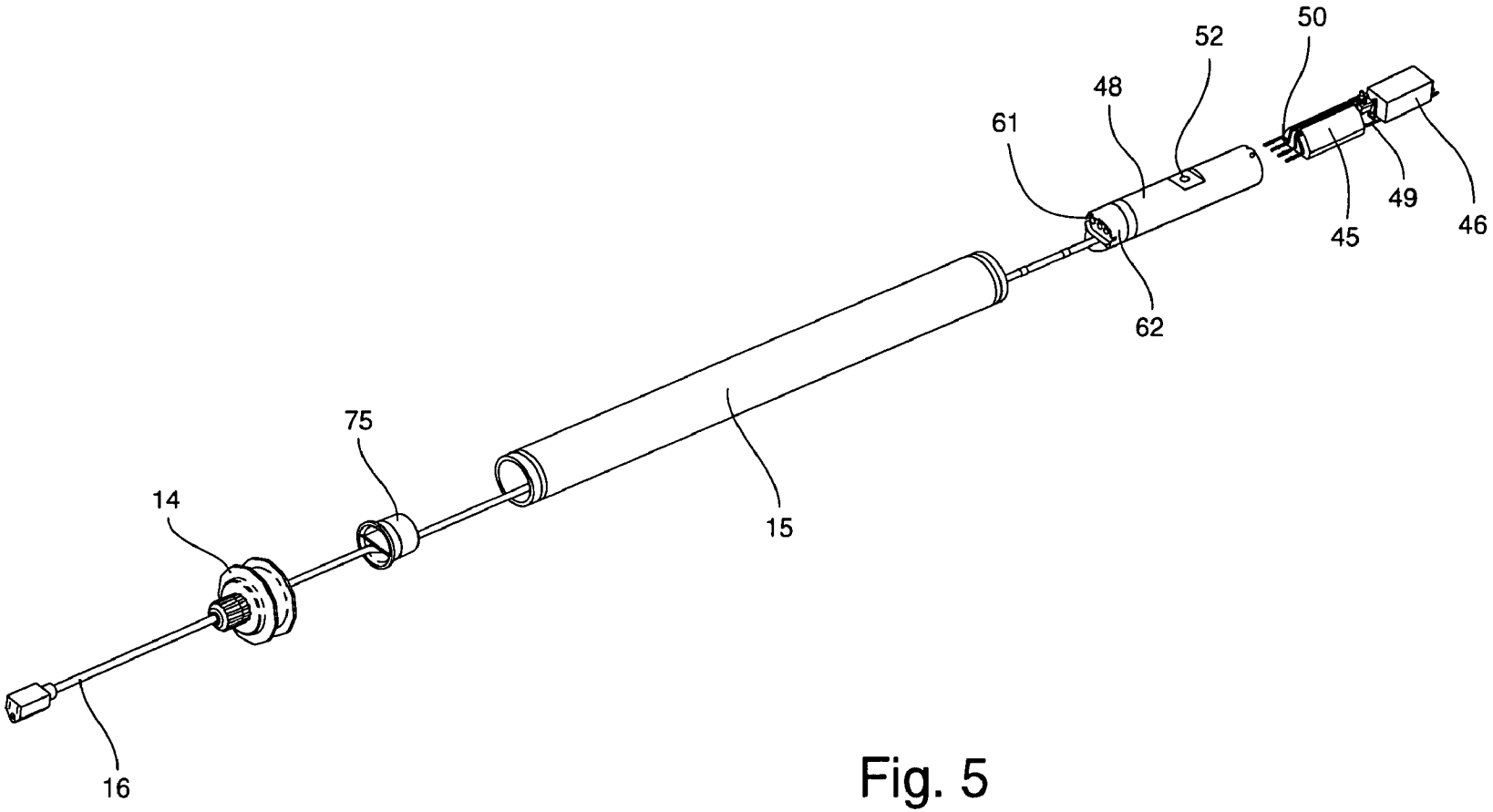
FIG. 5 is a perspective view of various components of the work light pull apart for clarity.
Figure 6:
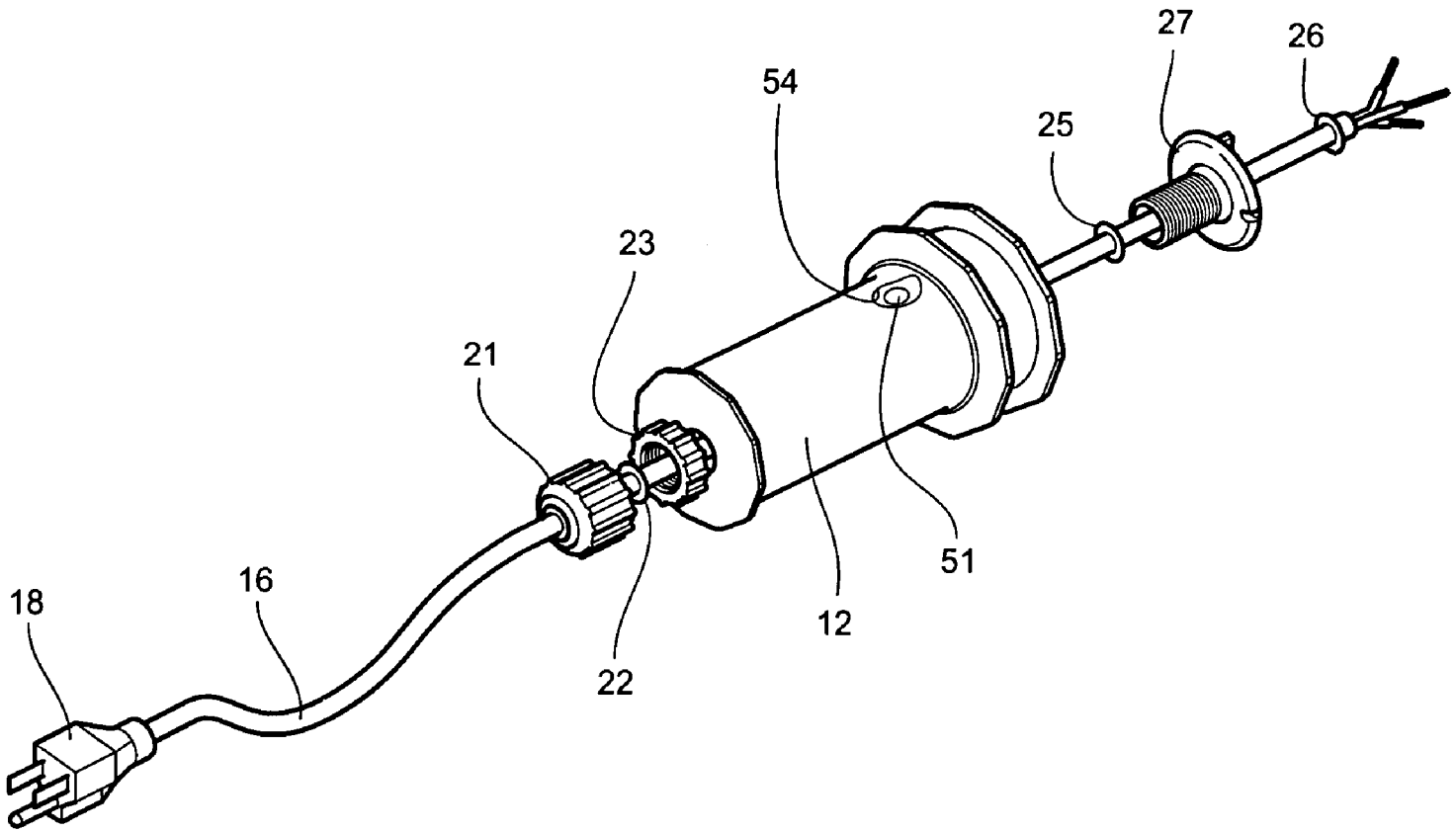
FIG. 6 is a perspective view of the handle.

Referring to FIGS. 1, 4, 5 and 6, the work light 10 includes components, such as a shock-absorbing rubber handle 12 and end cap 14 and a light-transmitting bulb shield 15, designed to protect the light 10 from damage during transport and use. Although handle 12 is specially designed for being gripped by a user, an alternative handle may comprise any extension formed adjacent one or both ends of the bulb shield 15. A power supply cord 16 extends through the work light 10, and includes respective male and female connectors 18 and 19 at opposite ends to allow connection of multiple lights together in series. As best shown in FIG. 6, a molded cap nut 21, sleeve insert 22, and jam nut 23 cooperate to provide cord strain relief at a distal end of the handle 12. Cord strain relief is provided at the opposite, proximal end of the handle 12 by rings 25 and 26 and molded disk 27.

Figure 7:
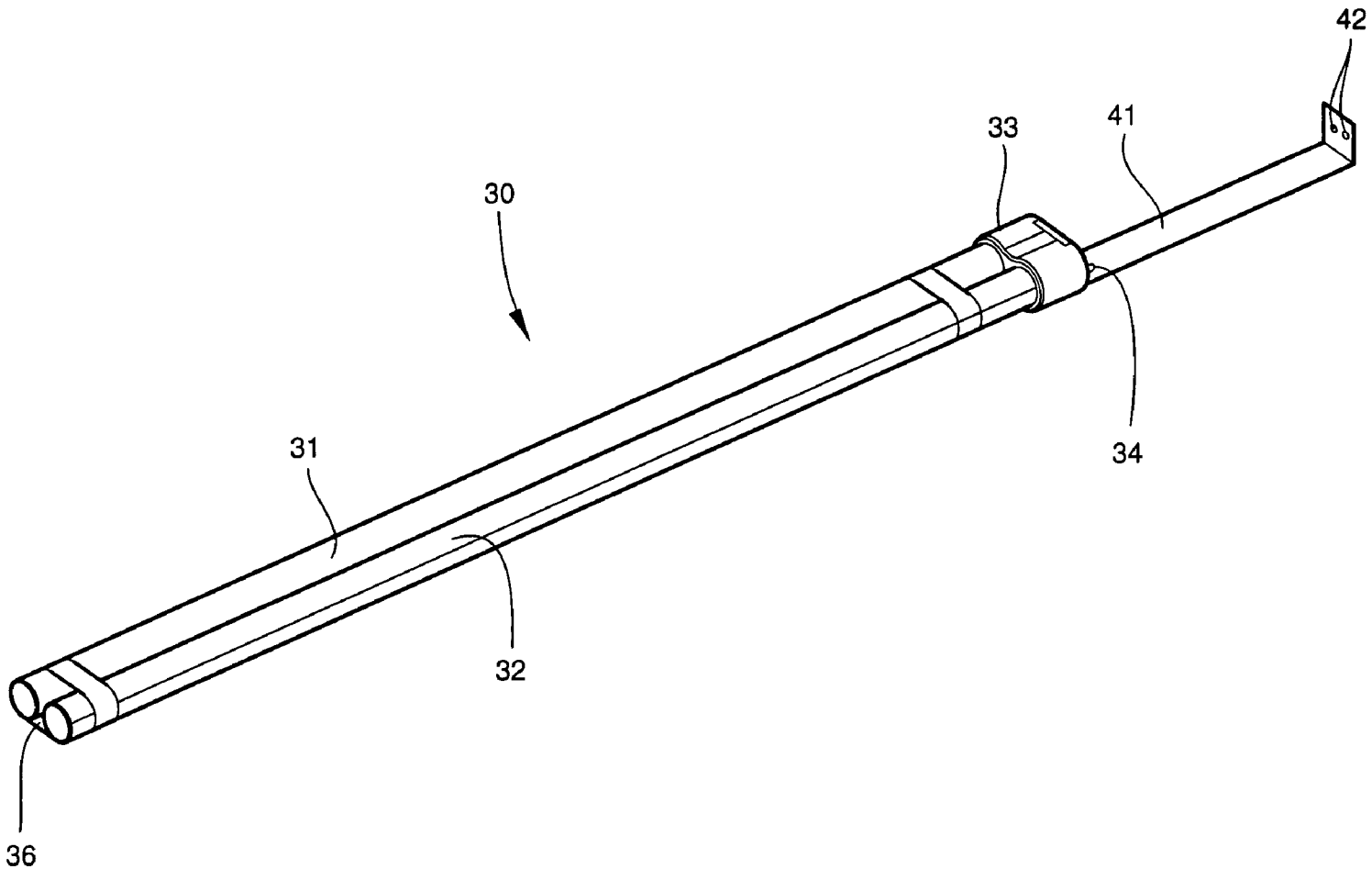
FIG. 7 is a perspective view of the flourescent bulb and pull strip.

The bulb shield 15 of the work light 10 is formed of a transparent, high-impact plastic. As shown in FIGS. 4 and 7, a replaceable bulb 30 is located inside the bulb shield 15 and includes a pair of elongated bulb tubes 31 and 32, a pin base 33, and electrode pins 34. According to one embodiment, the bulb 30 is a 50-Watt, phosphor-coated fluorescent bulb. For increased illumination, a white paper reflector 36 formed of standard card stock is preferably taped to the bulb tubes 31, 32. A perforated, tubular metal screen 38 surrounds the bulb tubes 31, 32 inside the bulb shield 15 and operates to reduce emissions generated during use of the work light 10. The exterior of the shield 15 is protected against scratching and scuffing by a removable color filter 39 suitably tinted to filter certain light emitted by the flourescent bulb 30. This component of the work light 10 is fully described in the Applicant's U.S. Pat No. 4,945,461 incorporated herein by reference.

A flexible pull strip 41 is located inside the bulb shield 15 for use in re-lamping the work light 10. The pull strip 41 is formed of a non-conductive, chrome-finished polymer material. One end of the pull strip 41 includes a reinforced portion with pin holes 42 adapted for receiving the electrode pins 34 of the bulb 30. The opposite end of the pull strip 41 extends slightly beyond the free end of the bulb 30 for convenient access. With a free end of the bulb shield 15 uncovered, the bulb 30 is removed from the work light 10 by gripping the end of the pull strip 41 and pulling in a direction away from the handle 12. The pull strip 41 is further described in Applicant's issued patent, U.S. Pat. No. 5,738,438, incorporated herein by reference.

Figure 8:
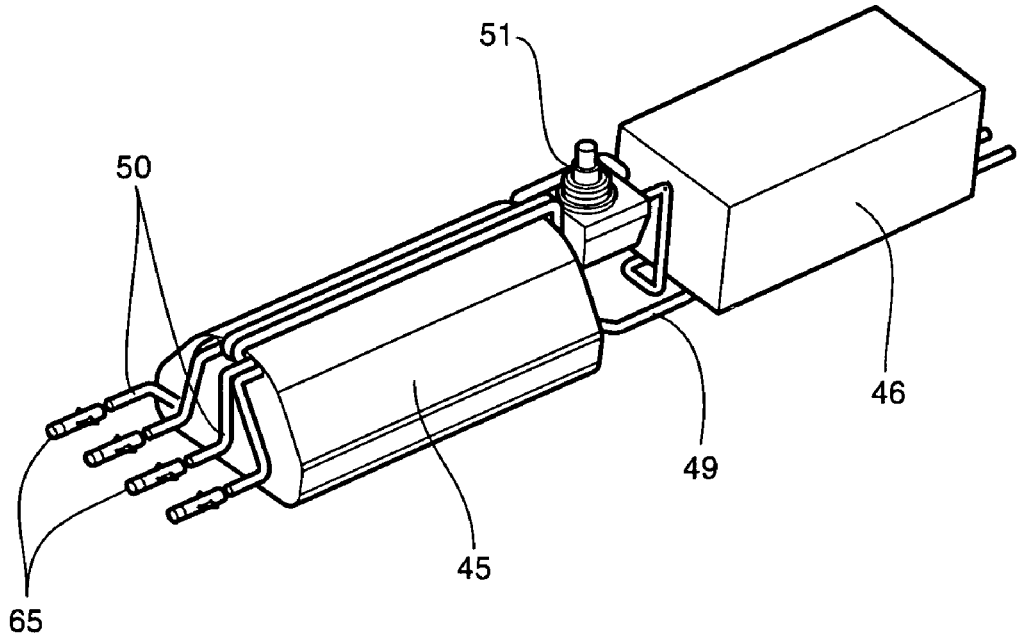
FIG. 8 is a perspective view of the ballast and filter.
Figure 9:
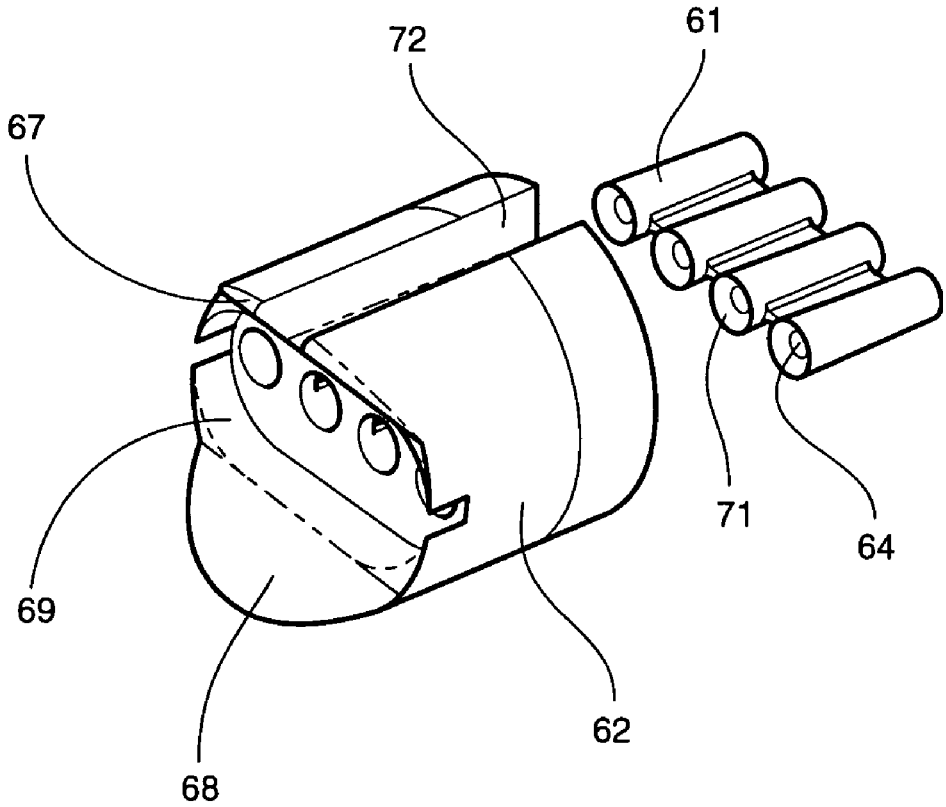
FIG. 9 is a perspective view of the shock with the molded bulb socket pulled apart for clarity.
Figure 10:
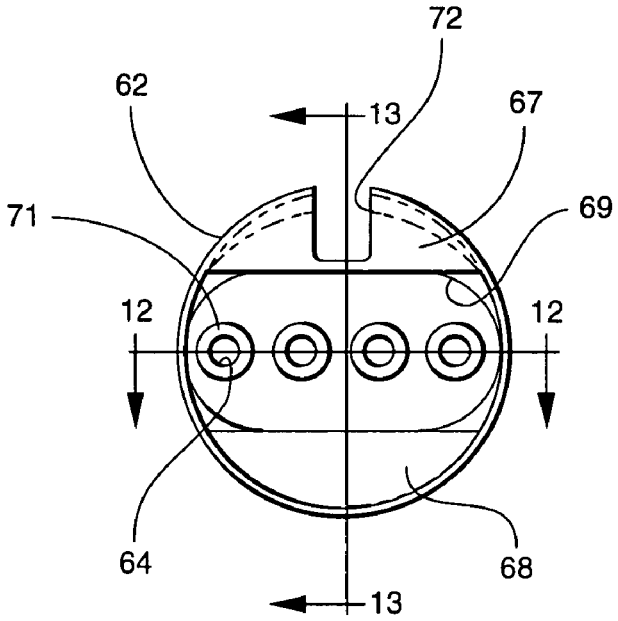
FIG. 10 is a top plan view of the bulb shock and socket.
Figure 11:
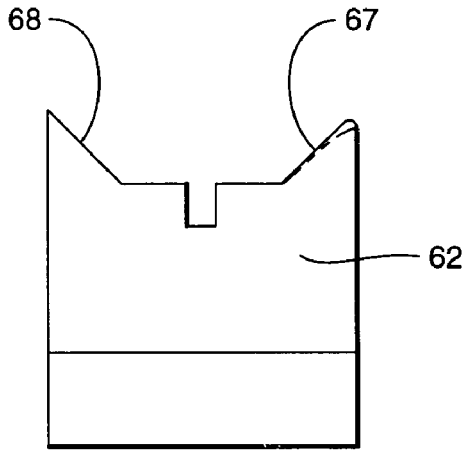
FIG. 11 is a side elevation of the bulb shock and socket.
Figure 12:
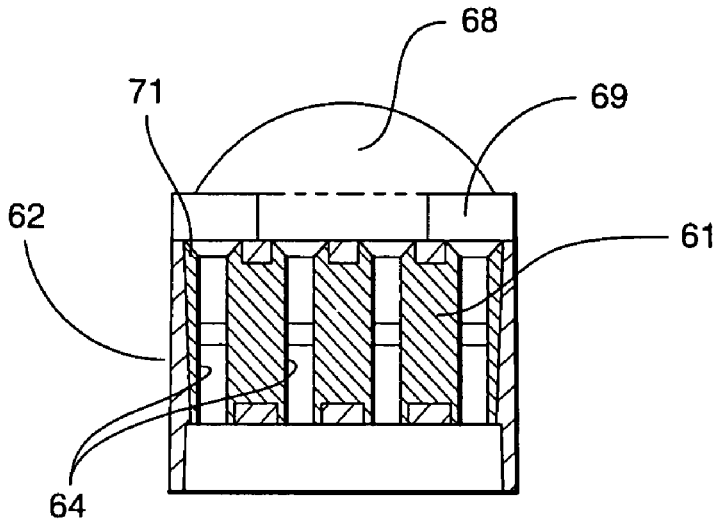
FIG. 12 is a cross-sectional view of the bulb shock and socket taken substantially along line 12—12 of FIG. 10.
Figure 13:
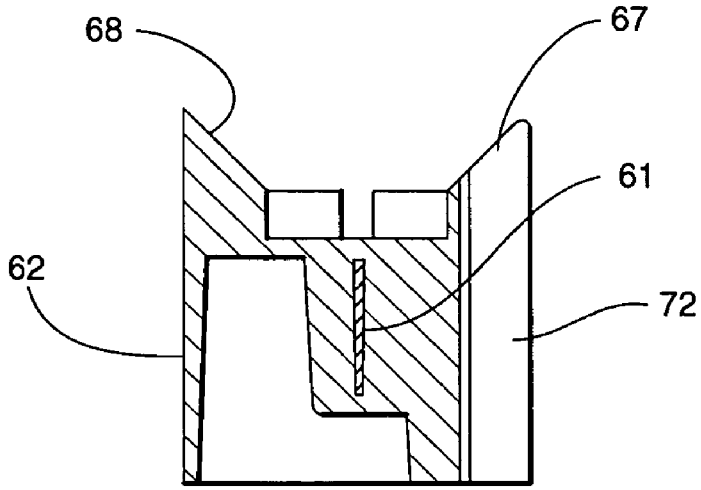
FIG. 13 is a cross-sectional view of the bulb shock and socket taken substantially along line 13—13 of FIG. 10.
Figure 14:
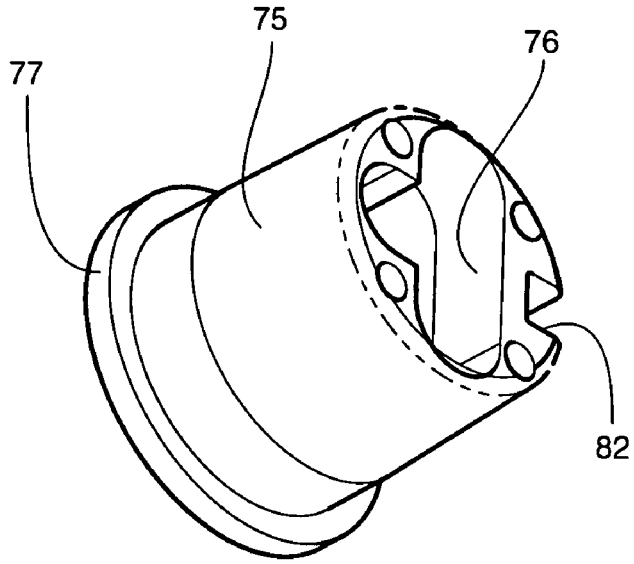
FIG. 14 is a perspective view of the shock-absorbing end plug.
Figure 15:
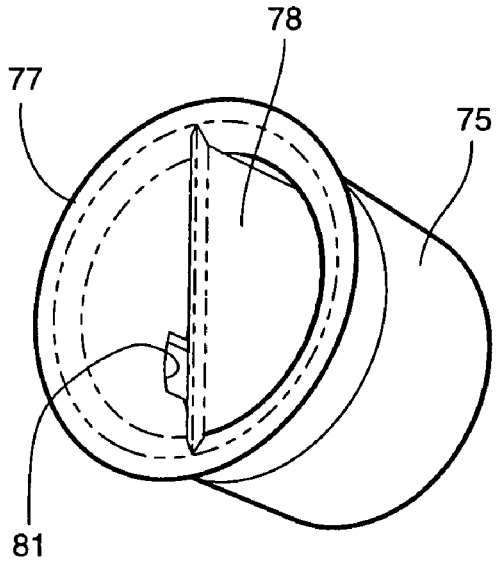
FIG. 15 is a second perspective view of the end plug.
Figure 16:
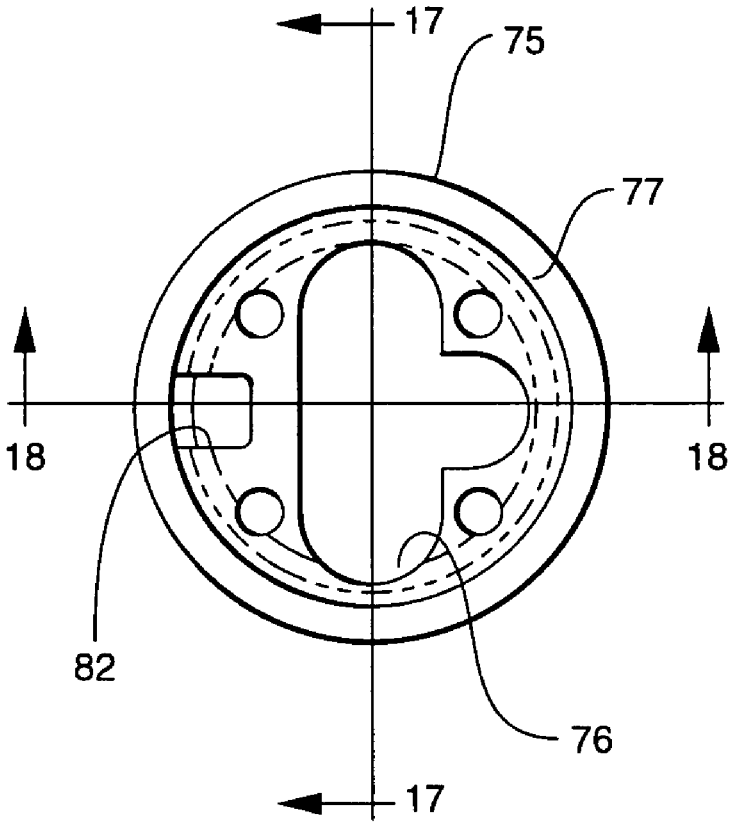
FIG. 16 is a top plan view of the end plug.
Figure 17:
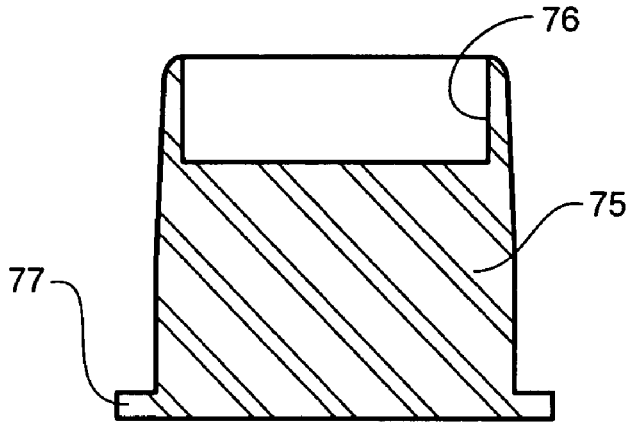
FIG. 17 is a is a cross-sectional view of the end plug taken substantially along line 17—17 of FIG. 16.
Figure 18:
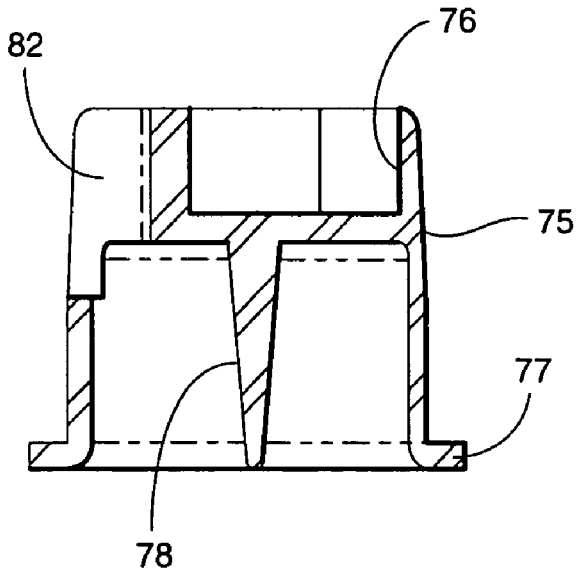
FIG. 18 is a cross-sectional view of the end plug taken substantially along line 18—18 of FIG. 16.

As shown in FIGS. 4, 5 and 8, an electronic ballast 45 and emissions filter 46 are stored in an emissions containment housing 48 located within the handle 12 of the work light 10. The ballast 45 and filter 46 are connected together by wires 49. Ballast wires 50 connect the ballast to the bulb 30. According to one embodiment, the emissions containment housing 48 is an open-ended cylindrical metal cup designed to fit entirely within the handle 12, and extend into an open end of the tubular metal screen 38. The proximal ends of the metal screen 38 and metal housing 48 engage each other in a close, wedged fit to provide continuous grounding, and to prevent the escape of emissions between the screen 38 and housing 48. For convenient activation of the work light 10 at the handle 12, the ballast 45 includes an activation switch 51 extending through aligned openings 52 and 54 in the housing 48 and handle 12, respectively. The switch 51 enables independent operation the work light 10 regardless of the number of other work lights connected together in series. When activated, the ballast 45 provides start-up voltage for the flourescent bulb 30 and serves to limit the electric current through the work light 10. Operation of the ballast 45 generates emissions which pass through the filter 46, and are substantially contained within the housing 48. The ballast 45, filter 46, containment housing 48, and perforated screen 38 cooperate to reduce both radiated and conducted emissions generated by the work light 10. The housing 48 and screen 38 is preferably formed of aluminum. According to one embodiment, the housing 48 is formed of 6061-T6 aluminum. The screen 38 is formed of 0.3003H14 aluminum, and is approximately 0.03 inches thick.

Referring to FIGS. 4 and 5, a molded bulb socket 61 and rubber shock 62 are located at a proximal end of the containment housing 48 between the electrode pins 34 of the bulb 30 and wires 50 of the ballast 45. As best shown in FIGS. 9-13, the bulb socket 61 is formed of a hard plastic material molded directly within the body of the shock 62. A number of longitudinal bores 64 extend through the bulb socket 61, and are adapted to interconnect respective pins 34 of the bulb 30 and wires 50 of the ballast 45. Barbed connectors 65 (See FIG. 8) are provided at terminal ends of the ballast wires 50 and are adapted for being inserted into a first end of the socket 61 through respective bores 64. The electrode pins 34 of the bulb 30 are inserted into the opposite end of the socket 61 through bores 64 to engage connectors 65. The rubber shock 62 provides impact resistance to further protect the bulb 30 from breaking if the work light 10 is dropped or damaged. According to one embodiment, the shock 62 is formed of an injection molded or extruded, medium hardness thermoplastic elastomer, such as PVC nitrile.

To facilitate proper placement of the bulb 30, the shock 62 has opposing, inwardly-tapered side walls 67 and 68 defining a guide recess for directing the bulb pins 34 into the through-bores 64 of the socket 61. The lower perimeter 69 of the guide recess is preferably contoured to secure the pin base 33 of the bulb 30. The mouth 71 at each through-bore 64 of the socket 61 defines an enlarged, generally conical opening adapted to readily accept the bulb pins 34. In addition, because the socket 61 is formed of a hard molded plastic, the bulb pins 34 engage the socket 61 at the enlarged conical openings and slide into respective through-bores 64 without friction interference. While the bulb socket 61 is preferably molded separately inside the rubber shock 62, as described and shown, the bulb socket 61 and shock 62 may be integrally-formed together as a single unit. A longitudinal channel 72 is formed along one side of the shock 62 to accommodate passage of the power supply cord 16 through the interior of the work light 10.

Figure 19:
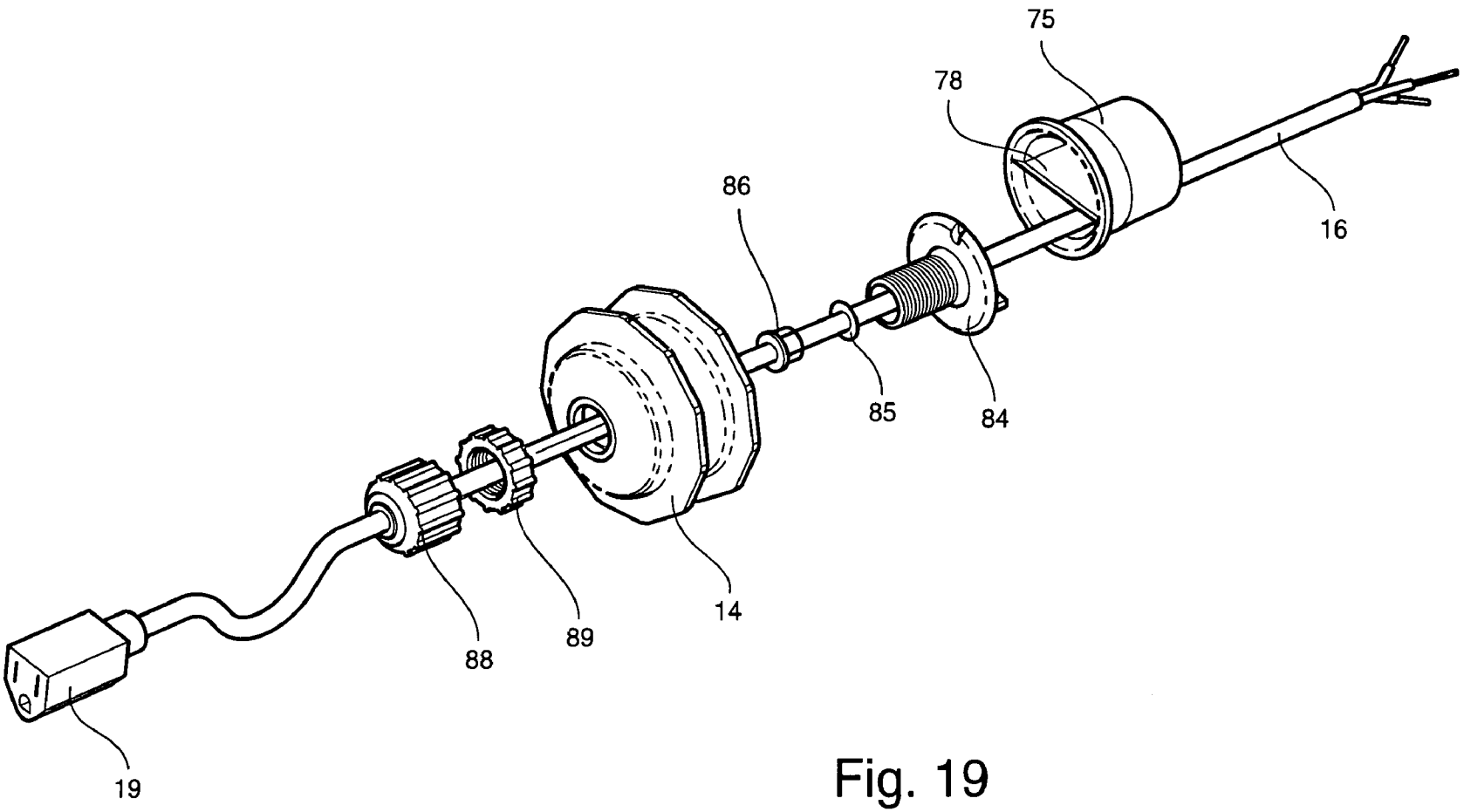
FIG. 19 is a perspective view showing the end cap, plug, and various strain relief components pulled apart along the power supply cord for clarity.

Referring again to FIGS. 4 and 5, a removable shock-absorbing plug 75 is located at the opposite end of the bulb shield 15 adjacent the end cap 14. The plug 75 engages and surrounds the free end of the bulb 30 inside the shield 15, and further protects the bulb 30 from damage caused by sudden impact to the work light 10. As best shown in FIGS. 14–18, the plug 75 has a first end which defines a contoured opening 76 adapted to receive the free end of the bulb 30. The opposite end of the plug 75 is recessed, and includes an annular flange 77 for engaging the annular peripheral edge of the bulb shield 15. An interior web 78 is formed in the recessed area of the plug 75, and is designed for being gripped by a user to conveniently remove the plug 75 from the shield 15 to access the bulb 30. To accommodate passage of the power supply cord 16, an opening 81 and channel 82 are formed in the side wall of the plug 75. As shown in FIG. 19, a molded disk 84, O-ring 85, and sleeve insert 86 are located between the end cap 14 and plug 75 to provide cord strain relief. A molded cap nut 88 and jam nut 89 cooperate on the other side the end cap 14 for added strain relief. According to one embodiment, the plug 75 is formed of an injection molded or extruded, medium hardness thermoplastic elastomer, such as PVC nitrile.

Figures 20, 21:
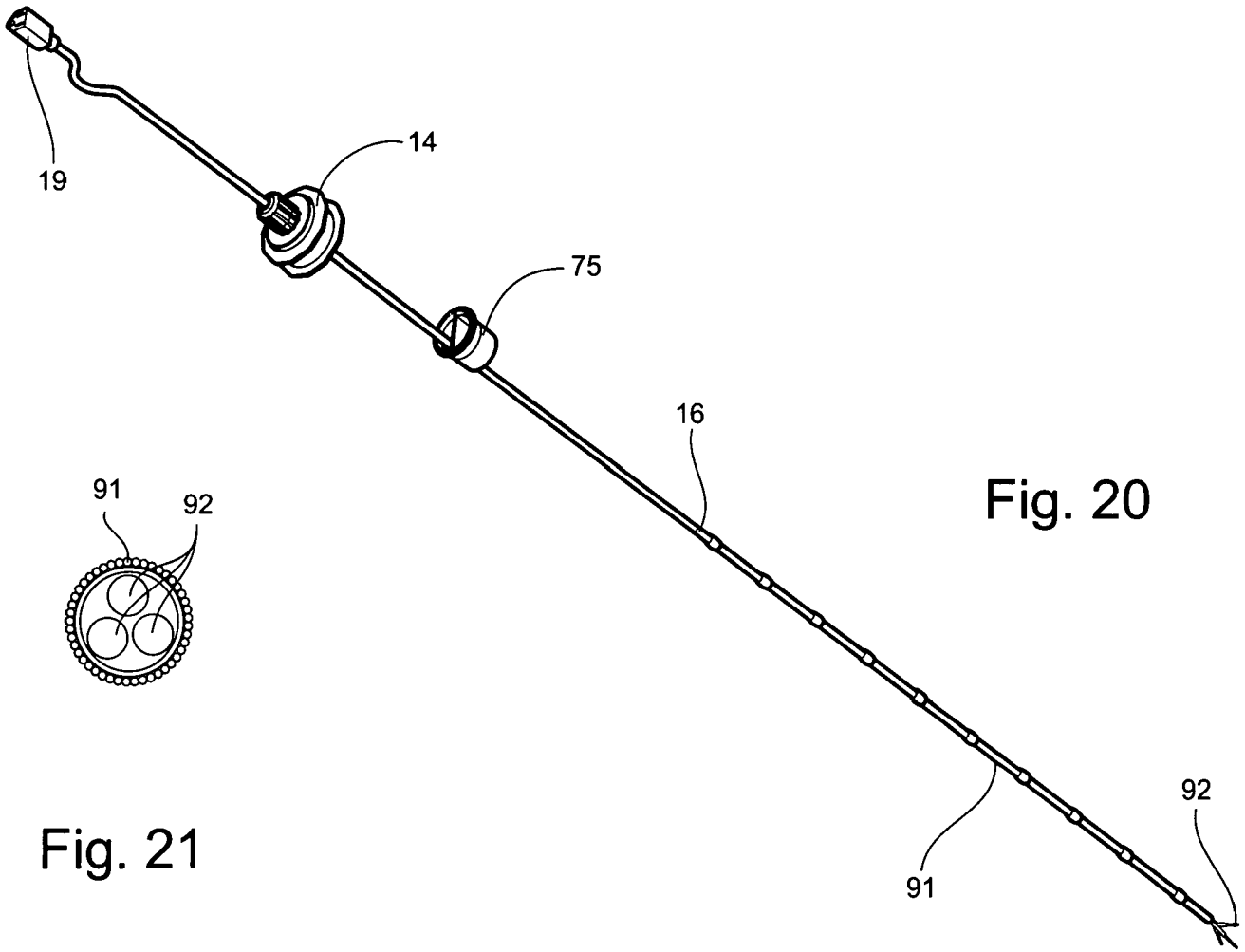
FIG. 20 is a fragmentary perspective view of power supply cord.
FIG. 21 is a cross-sectional view of the power supply cord taken substantially along line 21—21 of FIG. 20.

Referring to FIGS. 20 and 21, in order to further reduce emissions, a braided insulating sheath 91 is provided over the power supply cord 16. The sheath 91 comprises a 10 AWG copper tubular braid, and is preferably applied over the entire length of the power cord 16. The braided sheath 91 is secured to the cord 16 using any suitable means, such as standard electrical tape. The power cord 16 contains wires 92 adapted for carrying the electrical energy necessary to operate the work light 10.

Figure 22:
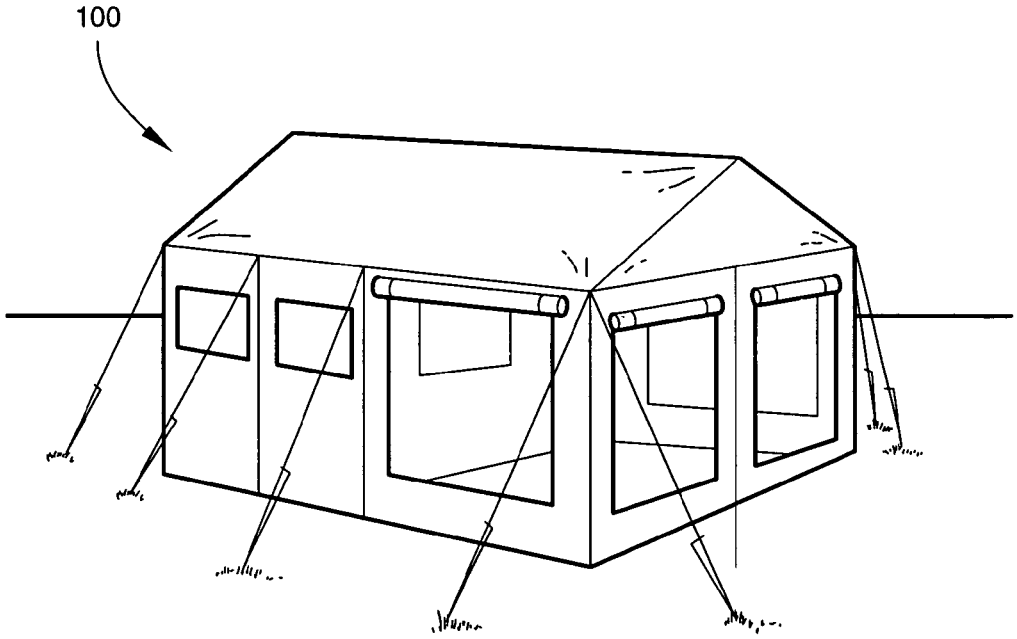
FIG. 22 illustrates a mobile shelter system including one or more of the work lights.

FIG. 22 illustrates a mobile shelter system 100. One or more of the work lights 10 are located within the shelter system 100 and suspended from overhead rods or straps to provide a convenient, energy efficient lighting system. The shelter system may be a military MCPU or LME, or any other such tent or enclosure.

For convenient assembly and disassembly, the components of the work light 10 include complementary snap-together attachment elements enabling ready access to and replacement of worn or damaged parts. In addition, all surface elements of the work light 10 are preferably non-conductive. The term non-conductive is defined as having sufficient dielectric to be considered non-conductive at voltages below 600 V AC. The work light 10 may also include one or more hanger hooks (not shown) for suspending the light from overhanging support structure inside the tent or enclosure.

A reduced emissions work light is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

We claim:

1. A reduced emissions work light, comprising:

(a) a bulb comprising an elongated bulb tube;

(b) an electromagnetic interference emissions containment housing located adjacent to said bulb;

(c) an electronic ballast located within said emissions containment housing and operatively connected to said bulb;

(d) an electromagnetic interference emissions filter operatively connected to said electronic ballast;

(e) a power supply cord adapted for being connected to a power source to supply electrical power to said work light, the power supply cord extending from a first end of the containment housing through the length of the containment housing to a second end of the containment housing; and (f) an emissions-insulating sheath positioned around the power supply cord to reduce electromagnetic emissions by the power supply cord when supplying electrical power to the work light, whereby the cumulative effect of the containment housing, electromagnetic emissions filter and power cord sheath results in a light meeting applicable military requirements for control of EMI emissions for lights having electronic ballasts.

2. A reduced emissions work light according to claim 1, and comprising a tubular, light-transmitting bulb shield surrounding said bulb tube to protect said bulb from damage.

3. A reduced emissions work light according to claim 2, and comprising a cylindrical shock-absorbing plug positioned within said bulb shield and engaging a free end of said bulb tube to further protect said bulb from damage.

4. A reduced emissions work light according to claim 3, wherein said plug includes an interior web for being gripped to remove said plug from said bulb shield.

5. A reduced emissions work light according to claim 2, and comprising a shock-absorbing end cap positioned over an end of said bulb shield.

6. A reduced emissions work light according to claim 1, and comprising a switch opening formed in said emissions containment housing to accommodate a ballast activation switch.

7. A reduced emissions work light according to claim 1, and comprising a removable color filter positioned over said bulb shield to filter light emitted by said bulb.

8. A reduced emissions work light according to claim 1, and comprising a light reflector located adjacent said bulb tube for enhancing illumination of said bulb.

9. A reduced emissions work light according to claim 1, and comprising an elongated pull strip releasably attached to said bulb for removing said bulb from said work light for replacement.

10. In combination with a mobile shelter system erected to create a covered interior, a portable reduced emissions work light adapted for illuminating the interior of said shelter system, said work light comprising:

(a) a bulb comprising an elongated bulb tube;

(b) an electromagnetic interference emissions containment housing located adjacent to said bulb;

(c) an electronic ballast located within said emissions containment housing and operatively connected to said bulb;

(d) an electromagnetic interference emissions filter operatively connected to said electronic ballast, whereby said emissions filter and emissions containment housing cooperate to reduce electromagnetic interference emissions generated by said work light;

(e) a power supply cord adapted for being connected to a power source to supply electrical power to said work light; and (f) an emissions-insulating sheath positioned around the power supply cord to reduce electromagnetic emissions by the power supply cord when supplying electrical power to the work light, whereby the cumulative effect of the containment housing, electomagnetic emissions filter and power cord sheath results in a light meeting applicable military requirements for control of EMI emissions for lights having electronic ballasts.

11. A combination according to claim 10, and comprising a tubular, light-transmitting bulb shield surrounding said bulb tube to protect said bulb from damage.

12. A combination according to claim 11, and comprising a cylindrical shock-absorbing plug positioned within said bulb shield and engaging a free end of said bulb tube to further protect said bulb from damage.

13. A combination according to claim 12, wherein said plug includes an interior web for being gripped to remove said plug from said bulb shield.

14. A combination according to claim 11, and comprising a shock-absorbing end cap positioned over an end of said bulb shield.

15. A combination according to claim 10, and comprising a switch opening formed in said emissions containment housing to accommodate a ballast activation switch.

16. A combination according to claim 10, and comprising a removable color filter positioned over said bulb shield to filter light emitted by said bulb.

17. A combination according to claim 10, and comprising a light reflector located adjacent said bulb tube for enhancing illumination of said bulb.

18. A combination according to claim 10, and comprising an elongated pull strip releasably attached to said bulb for removing said bulb from said work light for replacement.

* * * * *